US007156076B2

(12) United States Patent
Holl et al.

(10) Patent No.: US 7,156,076 B2
(45) Date of Patent: Jan. 2, 2007

(54) FUEL INJECTION DEVICE FOR AN INTERNAL COMBUSTION ENGINE

(75) Inventors: Andreas Holl, Ditzingen (DE); Achim Koehler, Ditzingen (DE); Sascha Ambrock, Gerlingen (DE); Martin Klander, Weinstadt (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/526,273

(22) PCT Filed: Mar. 18, 2003

(86) PCT No.: PCT/DE03/00883

§ 371 (c)(1),
(2), (4) Date: Mar. 2, 2005

(87) PCT Pub. No.: WO2004/029447

PCT Pub. Date: Apr. 8, 2004

(65) Prior Publication Data

US 2005/0241616 A1 Nov. 3, 2005

(30) Foreign Application Priority Data

Sep. 25, 2002 (DE) ..... 102 44 551

(51) Int. Cl.
*F02M 37/04* (2006.01)

(52) U.S. Cl. ..... 123/446; 123/456

(58) Field of Classification Search ..... 123/446, 123/458, 456, 514, 447
See application file for complete search history.

(56) References Cited

U.S. PATENT DOCUMENTS 4,884,545 A * 12/1989 Mathis ..... 123/447
5,275,207 A * 1/1994 Tonhauser et al. ..... 137/870
5,607,137 A * 3/1997 Kanda et al. ..... 251/129.07
5,884,606 A 3/1999 Kellner et al.
6,446,606 B1 9/2002 Krimmer et al.
6,446,607 B1 9/2002 Hlousek

FOREIGN PATENT DOCUMENTS

DE 196 30 938 A1 2/1998
DE 197 14 489 C1 10/1998
DE 198 38 812 C1 4/2000
DE 198 53 103 A1 5/2000
WO WO 01/34966 A2 5/2001

* cited by examiner

*Primary Examiner*—Carl S. Miller
(74) *Attorney, Agent, or Firm*—Ronald E. Greigg

(57) ABSTRACT

A fuel injection apparatus having a fuel supply pump supplying fuel to a high-pressure pump which delivers fuel into a reservoir with a metering device for adjusting the fuel quantity delivered into the reservoir; the metering device has a control valve triggered by an actuator. The control valve has a valve element guided in a cylinder of a valve housing can be slid by the actuator in opposition to a spring and in cooperation with an opening in the cylinder bore connected to an inlet from the supply pump or an outlet to the high-pressure pump, controls a flow cross section from the supply pump to the high-pressure pump. The valve element can close the flow cross section at least almost completely and also control a connection of the inlet from the supply pump or of the outlet to the high-pressure pump to a discharge region, and open this connection when it closes the flow cross section.

8 Claims, 3 Drawing Sheets

FUEL INJECTION DEVICE FOR AN INTERNAL COMBUSTION ENGINE

CROSS-REFERENCE TO RELATED APPLICATIONS

This application is a 35 USC 371 application of PCT/DE 03/00883 filed on Mar. 18, 2003.

BACKGROUND OF THE INVENTION

1. Field of the Invention

The invention is directed to an improved fuel injection apparatus for an internal combustion engine of the type including a fuel supply pump that delivers fuel to at least one high pressure pump which in turn delivers high pressure fuel to a reservoir.

2. Description of the Prior Art

A fuel injection apparatus known from DE 198 53 103 A1 has a fuel supply pump that delivers fuel to at least one high-pressure pump, which in turn delivers highly pressurized fuel to a reservoir. In addition, a fuel metering device is provided between the fuel supply pump and the high-pressure pump. The fuel metering device serves to control the quantity of fuel that the high-pressure pump delivers into the reservoir in accordance with operating parameters of the internal combustion engine. The fuel metering device includes an actuator in the form of an electromagnet and a check valve that is actuated by it, which has a slider-shaped valve element that is guided in a cylindrical bore of a valve housing and can be slid by an armature of the electromagnet in opposition to a return spring. The outer circumferential surface of the valve element, in cooperation with an outlet opening in the valve housing, controls a flow cross section from the fuel supply pump to the high-pressure pump in a stroke-dependent manner. When the valve element is in a closed position, its outer circumferential surface overlaps the outlet opening so that the flow cross section is completely closed. But since the valve element must be able to slide in the cylindrical bore of the valve housing, there must be a slight amount of play between its outer circumference and the cylindrical bore, through which a leakage quantity of fuel can flow and travel via the outlet opening to the high-pressure pump, even when, due to the operating parameter of the engine, for example when overrunning, the high-pressure pump is not supposed to deliver any fuel, during a so-called zero delivery. It is therefore necessary for steps to be taken in order to drain away this leakage quantity of fuel so that it cannot travel to the high-pressure pump and so that the zero delivery is achieved. To this end, a throttled connection to a discharge region can be provided; but in this case, fuel downstream of the fuel metering device constantly drains into the discharge region and in addition, there is an increased pressure level between the fuel metering device and the high-pressure pump. In order to prevent the high-pressure pump from taking in fuel, the opening pressure of at least one intake valve of the high-pressure pump must be set to a correspondingly high level; this, however, has a negative impact on the volumetric efficiency of the high-pressure pump. On the whole, this consequently requires a more complex design and more expensive manufacture of the fuel injection apparatus.

SUMMARY AND ADVANTAGES OF THE INVENTION

The fuel injection apparatus according to the invention, has the advantage over the prior art that when the valve element closes the flow cross section between the fuel supply pump and the high-pressure pump in order to achieve zero delivery, it opens a connection to a discharge region, which permits drainage of the fuel delivered by the fuel supply pump or of other fuel traveling into the high-pressure pump due to a leakage in the fuel metering device. Fuel is therefore drained into the discharge region only during zero delivery, during which the high-pressure pump is not supposed to deliver any fuel. This prevents a drop in fuel quantity particularly when starting the engine, when it is necessary for the high-pressure pump to deliver a large quantity of fuel. Only a low pressure is produced between the fuel metering device and the high-pressure pump since the valve element closes the flow cross section and opens the connection to the discharge region, through which the fuel delivered by the fuel supply pump or fuel traveling to the high-pressure pump due to leakage is drained away, thus making it possible to set the opening pressure of at least one intake valve of the high-pressure pump to a low level and nevertheless assure zero delivery. This permits a favorable filling and good volumetric efficiency of the high-pressure pump. The advantage of the outlet from the fuel metering device toward the high-pressure pump being connected to the discharge region is that the delivery pressure of the fuel supply pump is maintained between the fuel supply pump and the fuel metering device, which prevents irregularities in the march of pressure upstream of the fuel metering device and thus permits an improved adjustment of the pressure in the reservoir by means of the fuel metering device. In addition, the design correspondingly simplifies the design and manufacture of the fuel injection apparatus since no additional steps are required for the zero delivery.

BRIEF DESCRIPTION OF THE DRAWINGS

Other features and advantages of the invention will become apparent from the description contained below, taken in conjunction with the drawings, in which.

DESCRIPTION OF THE PREFERRED EMBODIMENTS

Figure 1:
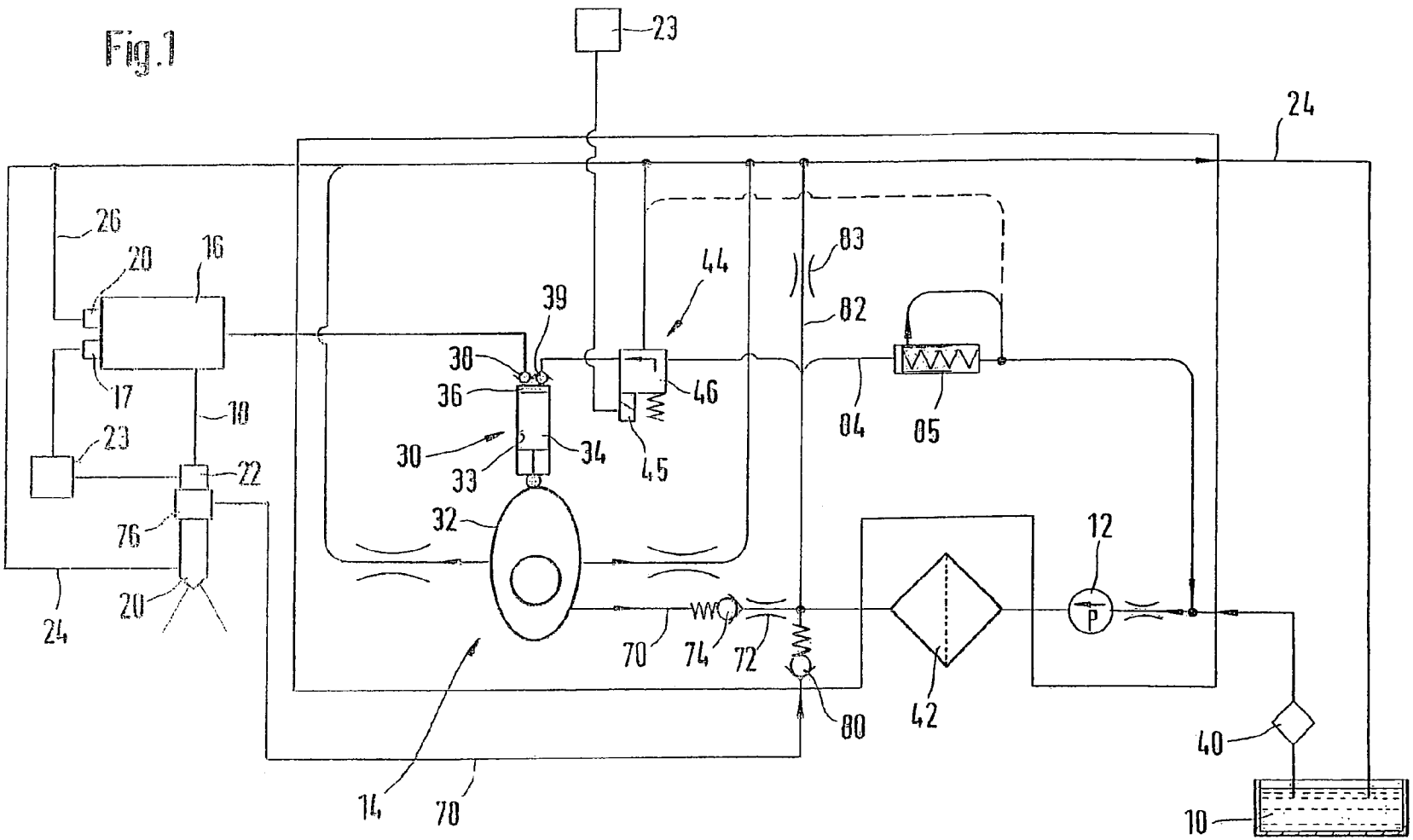
FIG. 1 is a schematic depiction of a fuel injection apparatus for an internal combustion engine.

FIG. 1 shows a fuel injection apparatus for an internal combustion engine, for example of a motor vehicle. The engine is preferably an autoignition internal combustion engine and has one or more cylinders. The motor vehicle has a fuel tank 10, which stores the fuel required for operating the engine. The fuel injection apparatus has a fuel supply pump 12 that delivers fuel from the fuel tank 10 to at least one high-pressure pump 14. The high-pressure pump 14 delivers fuel into a reservoir 16, which can be embodied as tubular, for example, but can also be embodied in any other shape. From the reservoir 16, lines 18 lead to injectors 20 provided at the individual cylinders of the engine. Each of the injectors 20 is provided with an electric control valve 22 that controls an opening of the injectors for the sake of triggering an injection of fuel by means of the associated injector 20 or preventing an injection of fuel. The control valves 22 are triggered by an electronic control unit 23, which determines the time and duration of the fuel injection by the injectors 20 in accordance with operating parameters of the engine such as engine speed, load, temperature, etc. From the injectors 20, a return for unused fuel leads at least indirectly, for example via a line 24 shared by all of the injectors, to a return line leading to the fuel tank 10. The reservoir 16 can also have a line 26 serving as a return, which leads back to the fuel tank 10 and which contains a pressure relief valve 28 in order to prevent an impermissibly high pressure from building up in the reservoir 16.

The high-pressure pump 14 is driven by the engine mechanically and therefore at a speed proportional to that of the engine. The fuel supply pump 12 can also be mechanically driven by the engine; the high-pressure pump 14 and the fuel supply pump 12 can be provided with a shared drive shaft. The fuel supply pump 12 can alternatively also be provided, for example, with an electromotive drive unit.

The high-pressure pump 14 can be embodied as a radial piston pump and has at least one, preferably several, pump elements 30, disposed at uniform angular distances from one another, which are each set into a stroke motion by means of a cam 32 in connection with a camshaft and each have a pump piston 34, which is guided in a cylinder bore 33 and delimits a pump working chamber 36. The connection leading from the pump working chamber 36 to the reservoir 16 contains a check valve 38 that opens toward the reservoir 16, serves as an outlet valve, and disconnects the pump working chamber 36 from the reservoir 16 during the intake stroke of the pump piston 34. The connection from the pump working chamber 36 to the fuel supply pump 12 contains a check valve 39 that opens toward the pump working chamber 36, serves as an intake valve, and disconnects the pump working chamber 36 from the fuel supply pump 12 during the delivery stroke of the pump piston 34. During an intake stroke of the pump piston 34, in which it moves radially inward, the opening intake valve 39 connects the pump working chamber 36 to the outlet of the fuel supply pump 12 so that the pump working chamber 36 is filled with fuel; the closed outlet valve 38 disconnects the pump working chamber 36 from the reservoir 16. During a delivery stroke of the pump piston 34, in which it moves radially outward, the pump working chamber 36 is connected to the reservoir 16 by the open outlet valve 38 and is disconnected from the outlet of the fuel supply pump 12 by the closed intake valve 39.

Preferably one or more filters are provided between the fuel supply pump 12 and the fuel tank 10. For example, starting from the fuel tank 10, first a coarse filter 40 is provided, followed by a fine filter 42; the fine filter 42 or the coarse filter 40 can also be equipped with a water separator. The return 24 from the injectors 20 can also feed into the line between the filter 40 and the fuel supply pump 12.

A fuel metering device 44 is provided between the fuel supply pump 12 and the high-pressure pump 14. The fuel metering device 44 has a control valve 46, which is controlled, for example, by means of an electric actuator 45, preferably an electromagnet or a piezoelectric actuator, and can continuously adjust the flow from the fuel supply pump 12 to the high-pressure pump 14. The fuel metering device 44 is also controlled by the control unit 23 in such a way that the fuel delivery pump 12 supplies a fuel quantity to the high-pressure pump 14, which the high-pressure pump 14 then delivers at high pressure into the reservoir 16 in order to maintain a pressure in the reservoir 16 that is predetermined as a function of operating parameters of the engine. The reservoir 16 is provided with a pressure sensor 17 that is connected to the control unit 23 and sends it a signal indicating the effective pressure in the reservoir 16.

Figure 2:
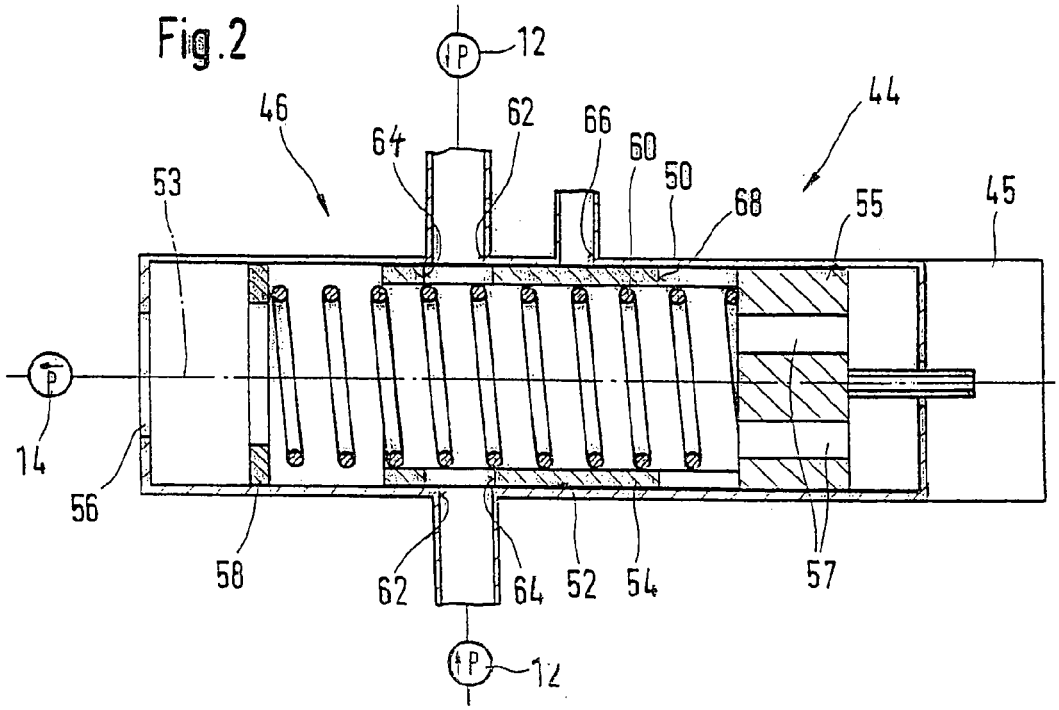
FIG. 2 is an enlarged depiction of a fuel metering device of the fuel injection apparatus according to a first exemplary embodiment, with a valve element in a first position.
Figure 3:
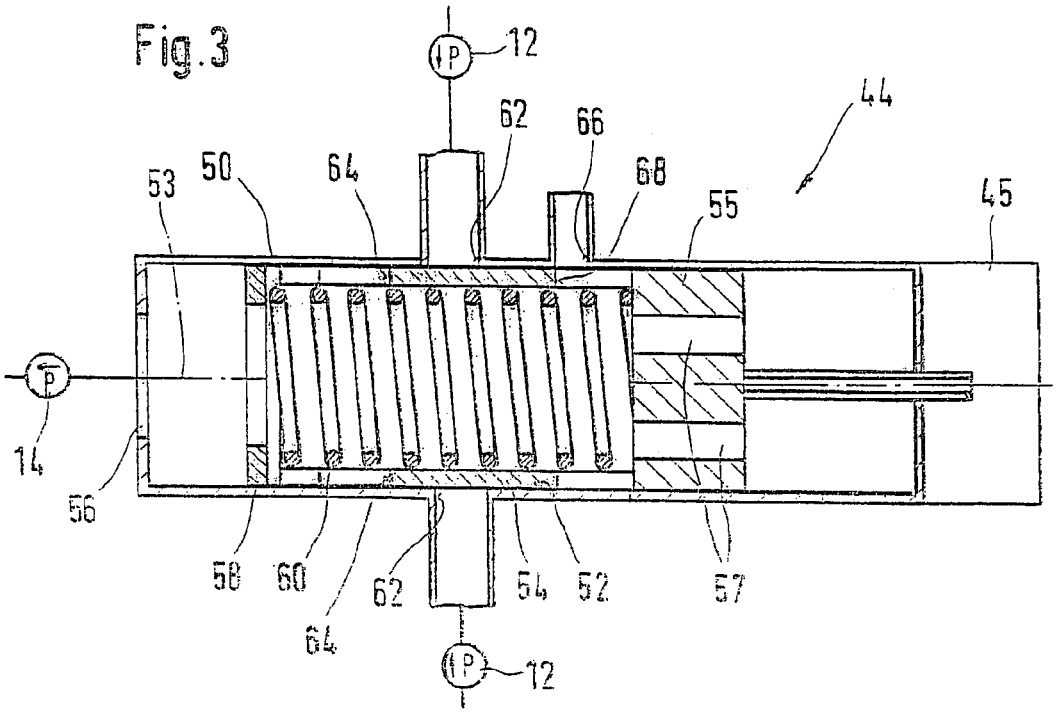
FIG. 3 shows the fuel metering device with the valve element in a second position.

FIGS. 2 and 3 show enlargements of the fuel metering device 44 according to a first exemplary embodiment. As part of the control valve 46, the fuel metering device 44 has a valve housing 50 in which a valve element 54 embodied in the form of a hollow piston is guided so that it can slide in a cylinder bore 52. The valve element 54 is cup-shaped; its bottom 55 and its circumferential surface can also be separate components that are connected to each other. The bottom 55 of the valve element 54 can also constitute a magnet armature of the actuator 45. The bottom 55 of the valve element 54 has at least one opening 57. The cylinder bore 52 in the valve housing 50 has an outlet 56 leading from it in an at least approximately axial direction, which leads to the high-pressure pump 14. The open end of the valve element 54 is oriented toward the opening 56. The valve element 54 is at least approximately pressure-balanced by means of the at least one opening 57 in the bottom 55. The actuator 45 engages the valve element 54 at its end oriented away from the opening 56. A support ring 58 is inserted into the cylinder bore 52, for example is press-fitted into it, and a spring 60 that extends into the valve element 54 is clamped between this support ring 58 and the bottom of the valve element 54. The position of the support ring 58 can be adjusted in the direction of the longitudinal axis 53 of the cylinder bore 52 to thus permit the setting of the initial stress of the spring 60. The support ring 58 has an opening that allows the fuel emerging from the opening 56 to pass through.

An inlet from the pressure side of the fuel supply pump 12 feeds into the circumference of the cylinder bore 52 through at least one opening 62. It is also possible for a number of openings 62 to be provided that are distributed over the circumference of the cylinder bore 52. The opening 62 can be embodied in the form of a slot that extends around part of the circumference of the cylinder bore 52. Depending on the placement and number of openings 62 in the cylinder bore 52, the circumference of the valve element 54 has at least one opening 64 that can also be embodied in the form of a slot extending around part of the circumference of the valve element 54. The valve element 54, by means of its at least one opening 64 cooperating with the at least one opening 62 in the cylinder bore 52, controls the size of a flow cross section in the connection between the fuel supply pump 12 and the high-pressure pump 14. A different size of flow cross section is opened depending on how much the opening 64 of the valve element coincides with the opening 62 of the cylinder bore 52. The valve element 54 changes the size of the flow cross section depending on its position in the direction of the longitudinal axis 53 of the cylinder bore 52. FIG. 2 shows the valve element 54 in an axial position in which its opening 64 completely coincides with the opening 62 of the cylinder bore 52, thus opening the maximum flow cross section. FIG. 3 shows the valve element 54 in an axial position in which the actuator 45 has slid it to the left in opposition to the spring 60 and its opening 64 no longer coincides with the opening 62 of the cylinder bore 52 so that the flow cross section is closed.

The circumference of the cylinder bore 52 also has at least one other opening 66 leading from it, which is offset from the opening 62 in the direction of the longitudinal axis 53 of the cylinder bore 52 away from the support ring 58 and which has a connection leading from it to a discharge region. This discharge region can be constituted by a return 24 to the fuel tank 10 as shown in FIG. 1 or can be constituted by the intake side of the fuel supply pump 12, as shown with dashed lines in FIG. 1. The circumference of the valve element 54 has a least one other opening 68, which is offset from the opening 64 toward the bottom in the direction of the longitudinal axis 53. By means of its opening 68, the valve element 54 controls the connection to the discharge region. The openings 66, 68 in the cylinder bore 52 and valve element 54 are disposed so that the opening 68 does not coincide with the opening 66 when the valve element 54 is disposed in axial positions in which a flow cross section is opened via the openings 62, 64, as shown in FIG. 2. In this position, the valve element 54 closes the connection to the discharge region so that fuel delivered by the fuel supply pump 12 can only travel to the high-pressure pump 14. The valve element 54 opens the connection to the discharge region when the actuator 45 moves it in the axial direction in opposition to the spring 60 until the flow cross section is completely closed since the openings 62, 64 no longer coincide, as shown in FIG. 3. As a result, fuel delivered by the fuel supply pump 12 can no longer reach the high-pressure pump 14. Fuel still reaching the high-pressure pump 14 due to a leakage between the valve element 54 and the cylinder bore 52 then flows through the openings 66, 68 to the discharge region. In intermediate positions of the valve element 54 between the two end positions according to FIGS. 2 and 3, the opening 64 of the valve element 54 only partially coincides with the bore 62 in the circumference of the cylinder bore 52 so that a flow cross section is opened that is correspondingly smaller than the maximum flow cross section, while the connection to the discharge region remains closed. It is also possible for the valve element 54 to be positioned in such a way that the opening 68 of the valve element 54 partially coincides with the opening 66 so that the connection to the discharge region is opened while the opening 64 of the valve element 54 still partially coincides with the opening 62.

The delivery pressure of the fuel supply pump 12 is maintained between the fuel supply pump 12 and the fuel metering device 44. This assures a reliable setting of the pressure in the reservoir 16 by the fuel metering device 44 since only slight pressure fluctuations occur in the inlet leading from the fuel supply pump 12 to the fuel metering device 44. By contrast with the above-explained embodiment of the fuel metering device 44, it is also possible to switch the respective positions of the inlet from the fuel supply pump 12 and the outlet to the high-pressure pump 14. The inlet from the fuel supply pump 12 then feeds axially into the cylinder bore 52 at the opening 56 and the outlet to the high-pressure pump 14 is connected to the openings 62 in the cylinder bore 52. During zero delivery, the valve element 54 consequently connects the inlet from the fuel supply pump 12 to the discharge region.

Figure 4:
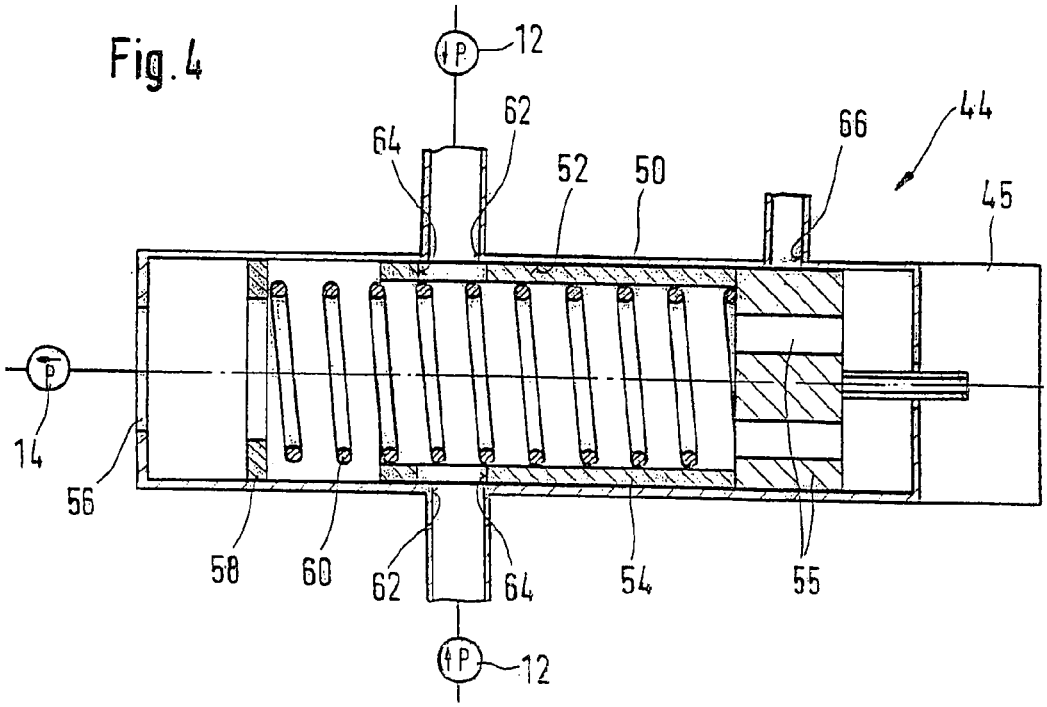
FIG. 4 shows the fuel metering device according to a second exemplary embodiment.

FIG. 4 shows the fuel metering device according to a second exemplary embodiment in which the design is largely the same as in the first exemplary embodiment. By contrast with the first exemplary embodiment, the valve element 54 in the second exemplary embodiment has only the at least one opening 64 that controls the size of the flow cross section between the fuel supply pump 12 and the high-pressure pump 14. The circumference of the cylinder bore 52 has the at least one opening 62, with the at least one additional opening 66 disposed offset from it at a relatively large axial distance, which additional opening produces the connection to the discharge region. By means of its circumferential surface, the valve element 54 controls the opening process of the opening 66 and therefore the connection to the discharge region in such a way that the opening 66 is closed when the valve element 54 completely overlaps the opening 66 and the opening 66 is opened when the valve element 54 does not overlap or only partially overlaps the opening 66. As in the first exemplary embodiment, the valve element 54 closes the opening 66 and therefore the connection to the discharge region as long as the valve element 54 opens a flow cross section via the openings 62, 64. Only when the valve element 54 has at least almost entirely closed the flow cross section via the openings 62, 64 does it open the opening 66 and therefore the connection to the discharge region.

As indicated in the first exemplary embodiment, in the second exemplary embodiment, it is also possible to switch the positions of the inlet from the fuel supply pump 12 and the outlet to the high-pressure pump 14 so that the inlet feeds into the opening 56 and the outlet is connected to the openings 62 in the cylinder bore 52.

Figure 5:
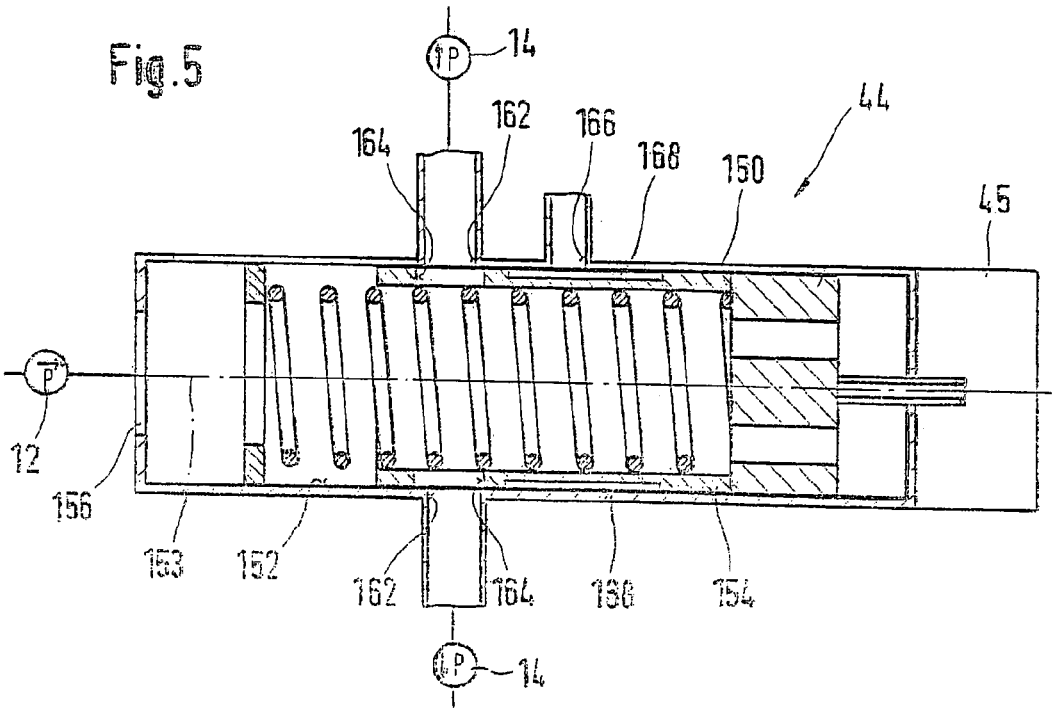
FIG. 5 shows the fuel metering device according to a third exemplary embodiment.

FIG. 5 shows the fuel metering device according to a third exemplary embodiment in which the design is once again largely the same as in the first exemplary embodiment. By contrast with the first exemplary embodiment, however, the inlet from the fuel supply pump 12 feeds into the cylinder bore 152 at a for example axially disposed opening 156 and at least one opening 162 of the outlet to the high-pressure pump 14 leads out from the circumference of the cylinder bore 152. The circumference of the cylinder bore 152 also has at least one other opening 166, which is offset in the axial direction in relation to the opening 162 and produces a connection to a discharge region. In its circumference, the valve element 154 has at least one opening 164, which, in cooperation with the opening 162, controls the flow cross section of the connection between the fuel supply pump 12 and the high-pressure pump 14. In its circumference, the valve element 154 has at least one groove 168 that extends in the direction of the longitudinal axis 153 and over part of the circumference, which groove controls a connection between the opening 162 and the opening 166. When the valve element 154 opens a flow cross section via the openings 162, 164, then the groove 168 does not coincide with the opening 162 so that fuel can only travel from the fuel supply pump 12, through the openings 162, 164, to the high-pressure pump 14. When the valve element 154 has at least almost completely closed the flow cross section since the opening 164 no longer coincides or almost no longer coincides with the opening 162, then the groove 168 coincides with the opening 162 and thus produces a connection to the opening 166. Fuel then flows from the opening 162 directly to the opening 166 and into the discharge region.

In the fuel metering device 44 according to the third exemplary embodiment, it is also possible to switch the positions of the inlet from the fuel supply pump 12 and the outlet to the high-pressure pump 14 so that the inlet from the fuel supply pump 12 feeds into the openings 162 and the outlet that is connected to the cylinder bore 152 at the opening 156.

During zero delivery, when the high-pressure pump 14 is not permitted to send fuel into the reservoir 16, the control unit triggers the actuator 45 of the fuel metering device 44 in such a way that the valve element 54 or 154 completely closes the flow cross section of the connection between the fuel supply pump 12 and the high-pressure pump 14 and the outlet from the fuel metering device 44 to the high-pressure pump 14 is connected to the discharge region. Consequently, only a slight pressure prevails on the intake side of the high-pressure pump 14 during zero delivery. Only a small amount of fuel passes through the fuel metering device 44 due to a possible leakage between the valve element 54 or 154 and the cylinder bore 52 or 152 and can drain away to the discharge region. This makes it possible to set a low opening pressure of the intake valve 39 of the at least one pump element of the high-pressure pump 14. This in turn permits a favorable filling of the pump working chamber 36 during fuel delivery by the high-pressure pump 14 and a favorable volumetric efficiency of the pump. The spring 60 can be designed to have a relatively high rigidity, which permits achievement of an advantageous characteristic curve of the fuel metering device 44 and therefore of the high-pressure pump 14. By means of its opening 64 or 164, the valve element 54 or 154 of the fuel metering device 44 can open a large flow cross section so that it is also possible to control large delivery quantities of the high-pressure pump 14.

Upstream of the fuel metering device 44, the connection between the fuel supply pump 12 and the high-pressure pump 14 can have a bypass line 70 branching from it that contains a throttle restriction 72 and a pressure valve 74 and leads into a drive region of the high-pressure pump 14. If a sufficiently high pressure prevails downstream of the fuel supply pump 12, then the pressure valve 74 opens, thus opening the bypass connection 70. The bypass line 70 supplies fuel to the drive region of the high-pressure pump 14 for lubrication purposes. The throttle restriction 72 limits the quantity of fuel that flows out via the bypass connection 70. From the drive region, fuel flows into the return to the fuel tank 10. Between the reservoir 16 and the injectors 20, it is possible to provide a pressure boosting device 76, which boosts the pressure prevailing in the reservoir 16 so that a fuel injection by means of the injectors 20 occurs at a pressure higher than the pressure prevailing in the reservoir 16. From the pressure boosting device 76, a return 78 can lead into the connection between the fuel supply pump 12 and the high-pressure pump 14, upstream of the fuel metering device 44. The return 78 contains a check valve 80 that opens toward the connection.

Upstream of the fuel metering device 44, the connection between the fuel supply pump 12 and the high-pressure pump 14 can have another bypass connection 82 branching from it that contains a throttle restriction 83 and leads to a return into the fuel tank 10, which makes it possible to bleed off air. In addition, upstream of the fuel metering device 44, the connection between the fuel supply pump 12 and the high-pressure pump 14 can have yet another bypass connection 84 branching from it that leads to the intake side of the fuel supply pump 12 or to the return 24 and contains a pressure valve 85 that opens toward the intake side of the fuel supply pump 12 or toward the return 24. The bypass connection 84 with the pressure valve 85 limits the pressure prevailing in the connection between the fuel supply pump 12 and the high-pressure pump 14.

The foregoing relates to preferred exemplary embodiments of the invention, it being understood that the other variants and embodiments thereof are possible within the spirit and scope of the invention, the latter being defined by the appended claims.

The invention claimed is:

1. A fuel injection apparatus for an internal combustion engine, the apparatus comprising, a fuel supply pump (12) that supplies fuel from a fuel tank (10) to the intake side of at least one high-pressure pump (14), the high-pressure pump (14) being operable to deliver fuel into a reservoir (16) in accordance with operating parameters of the engine, a fuel metering device (44) for adjusting the fuel quantity that the high-pressure pump (14) delivers into the reservoir (16), the fuel metering device (44) having an actuator (45) and a control valve (46) triggered by this actuator, the control valve (46) having a valve element (54; 154) guided in a cylinder bore (52; 152) of a valve housing (50; 150) and the actuator (45) being operable to slide this valve element in opposition to a return force (60), and the valve element (54; 154), in cooperation with an aperture (62; 162) disposed in the circumference of the cylinder bore (52; 152) and connected to either an inlet from the fuel supply pump (12) or to an outlet to the high-pressure pump (14), controlling a flow cross section in the connection from the fuel supply pump (12) to the high-pressure pump (14), the valve element (54; 154) being operable to close the flow cross section at least almost completely, the valve element (54; 154) also controlling a connection either of the inlet from the fuel supply pump (12) or of the outlet to the high-pressure pump (14) to a discharge region, the valve element (54; 154) opening this connection when it closes the flow cross section, wherein the valve element (54) is embodied as hollow and its circumference has at least one aperture (64; 68) which, in cooperation with the aperture (62, 66) in the circumeference of the cylinder bore (52), controls the connection to the discharge region and the flow cross section in the connection between the fuel supply pump (12) and the high-pressure pump (14).

2. The fuel injection apparatus according to claim 1, wherein the outlet to the high-pressure pump (14) feeds into the cylinder bore (52) at an opening (56), wherein the inlet from the fuel supply pump (12) and the connection to the discharge region are each connected to at least one aperture (62, 66) in the circumference of the cylinder bore (52), and wherein the circumference of the valve element (54), in cooperation with the apertures (62, 66),controls the connection to the discharge region and the flow cross section in the connection between the fuel supply pump (12) and the high-pressure pump (14).

3. The fuel injection apparatus according to claim 1, wherein the outlet to the high-pressure pump (14) and the connection to the discharge region are each connected to at least one aperture (162, 166) in the circumference of the cylinder bore (152), wherein the inlet from the fuel supply pump (12) feeds into the cylinder bore (152) at an opening (156), and wherein the circumference of the valve element (154), in cooperation with the apertures (162, 166) in the circumference of the cylinder bore (152), controls the flow cross section in the connection between the fuel supply pump (12) and the high-pressure pump (14) and the connection of the outlet to the high-pressure pump (14) to the discharge region.

4. The fuel injection apparatus according to claim 3, wherein the outer circumference of the valve element (154) contains a groove (168) extending in the direction of its longitudinal axis (153), which groove, in order to open the connection between the outlet to the high-pressure pump (14) and the connection to the discharge region, is brought into a position in which it coincides with the aperture (162) of the outlet in the circumference of the cylinder bore (152).

5. The fuel injection apparatus according to claim 1, wherein the at least one high-pressure pump (14) has at least one pump element (30) with a pump working chamber (36), and wherein an intake valve (39) that opens toward the pump working chamber (36) is provided between the fuel metering device (44) and the pump working chamber (36).

6. The fuel injection apparatus according to claim 2, wherein the at least one high-pressure pump (14) has at least one pump element (30) with a pump working chamber (36), and wherein an intake valve (39) that opens toward the pump working chamber (36) is provided between the fuel metering device (44) and the pump working chamber (36).

7. The fuel injection apparatus according to claim 3, wherein the at least one high-pressure pump (14) has at least one pump element (30) with a pump working chamber (36), and wherein an intake valve (39) that opens toward the pump working chamber (36) is provided between the fuel metering device (44) and the pump working chamber (36).

8. The fuel injection apparatus according to claim 4, wherein the at least one high-pressure pump (14) has at least one pump element (30) with a pump working chamber (36), and wherein an intake valve (39) that opens toward the pump working chamber (36) is provided between the fuel metering device (44) and the pump working chamber (36).

* * * * *